US010465344B2

(12) United States Patent
Bhatia et al.

(10) Patent No.: US 10,465,344 B2
(45) Date of Patent: Nov. 5, 2019

(54) COVERING DEVICE FOR A SLOTTED CHANNEL

(71) Applicant: ACO Severin Ahlmann GmbH & Co. Kommanditgesellschaft, Budelsdorf (DE)

(72) Inventors: Ramon Bhatia, Rendsburg (DE); Jiri Krcil, Zdarnad Sazavou (CZ); Heino Messerschmidt, Lutjenwestedt (DE); Jan Mieze, Kiel (DE)

(73) Assignee: ACO SEVERIN AHLMANN GMBH & CO KG, Budelsdorf (DE)

( * ) Notice: Subject to any disclaimer, the term of this patent is extended or adjusted under 35 U.S.C. 154(b) by 0 days.

(21) Appl. No.: 16/322,295

(22) PCT Filed: Sep. 12, 2017

(86) PCT No.: PCT/EP2017/072821

§ 371 (c)(1),
(2) Date: Jan. 31, 2019

(87) PCT Pub. No.: WO2018/046744

PCT Pub. Date: Mar. 15, 2018

(65) Prior Publication Data

US 2019/0194881 A1 Jun. 27, 2019

(30) Foreign Application Priority Data

Sep. 12, 2016 (DE) ..... 10 2016 117 070

(51) Int. Cl.

| | |
|---|---|
| ***E01C 11/00*** | (2006.01) |
| ***E01C 11/22*** | (2006.01) |
| ***E03F 3/04*** | (2006.01) |

(52) U.S. Cl.
CPC ..... *E01C 11/227* (2013.01); *E03F 3/046* (2013.01)

(58) Field of Classification Search
CPC ..... E01C 11/227; E03F 3/046
(Continued)

(56) References Cited

U.S. PATENT DOCUMENTS 4,793,725 A * 12/1988 Cheng ..... A47G 1/065 403/170
6,017,166 A * 1/2000 Mossburg, Jr. ..... E03F 1/00 210/163

(Continued)

FOREIGN PATENT DOCUMENTS

DE 202005001437 U1 5/2005
DE 202011051082 U1 10/2011

(Continued)

*Primary Examiner* — Raymond W Addie
(74) *Attorney, Agent, or Firm* — Pearne & Gordon LLP

(57) ABSTRACT

Slotted channels with coverings (10) are known for discharging surface water into a channel. The covering has at least one horizontal sheet-metal portion (13) and two vertical sheet-metal portions (11, 12) which are connected to one another via connection devices and have a slot (14) between one another for discharging liquid, for example surface water, into the channel body. In order to allow a particularly complete discharge of water, it is proposed that the horizontal sheet-metal portion (13) comprises drip devices (15) which are mounted and designed in such a way that water running along on an underside of the horizontal sheet-metal portion (13) drips into the channel body.

10 Claims, 4 Drawing Sheets

Figure 1:
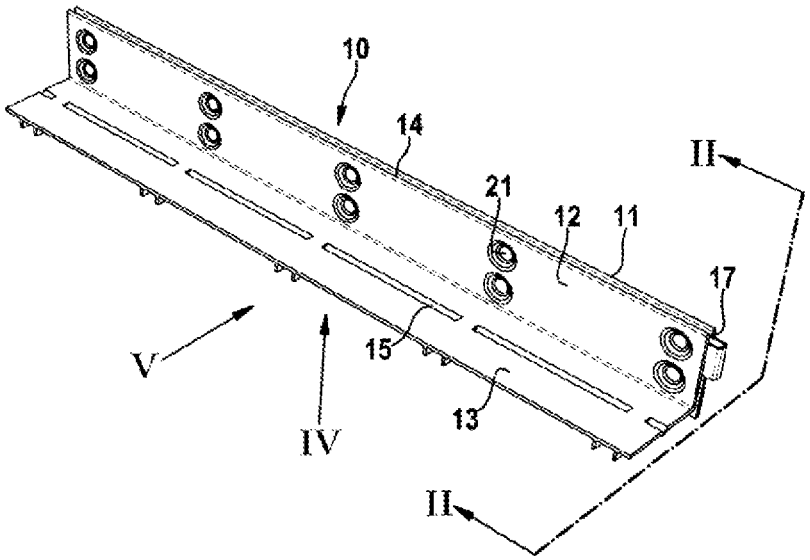

(58) Field of Classification Search
USPC ..... 404/6
See application file for complete search history.

(56) References Cited

U.S. PATENT DOCUMENTS

| | | | | |
|---|---|---|---|---|
| 7,246,969 | B2 * | 7/2007 | Orser | E01C 11/223 404/2 |
| 8,523,477 | B2 * | 9/2013 | Lill | E03F 5/06 404/2 |
| 8,894,324 | B2 * | 11/2014 | Cucchiara | E01C 13/00 405/43 |
| 2005/0207839 | A1 * | 9/2005 | Tremouilhac | E03F 5/046 404/5 |

FOREIGN PATENT DOCUMENTS

| | | | |
|---|---|---|---|
| EP | 0167384 | A2 | 1/1986 |
| EP | 2746476 | A1 | 6/2014 |
| WO | 2008132446 | A2 | 11/2008 |
| WO | 2014037551 | A1 | 3/2014 |

* cited by examiner

COVERING DEVICE FOR A SLOTTED CHANNEL

The invention relates to the cover of a slit gutter according to the preamble of patent claim 1.

Liquids must be removed from surfaces. In particular, this applies to rainwater which has to be drained as quickly as possible into a sewage system by way of drainage devices e.g. for reasons of traffic safety. For aesthetic reasons, it may be desirable not to work with a grate but with a drainage slit that can be bordered by pavement on both sides. Such a slit-shaped interruption of a paved area is visually appealing. Such a slit gutter is known from EP 2 562 316 A1 for instance.

In contrast to drains, which are covered by a grate, the slit of such a gutter (hereinafter called slit gutter) is a channel, which is to conduct the liquid or the water to be guided to a gutter body. The connection between the cover, i.e. the part forming the slit, and the gutter body is to completely guide the water into the gutter body. It must be ensured that as little water as possible discharges into the environment adjacent to the gutter.

In addition, it is required that the cover can be manufactured simply and inexpensively and a simple and also cost-effective installation of a slit gutter strand also has to be ensured.

The invention addresses the problem of developing a cover of the type mentioned in such a way that a high drainage performance is ensured at low manufacturing and assembly costs.

This object is achieved by a cover according to claim 1.

This object is achieved in particular for a cover of a slit gutter comprising a gutter body having upper rims for fitting the cover, wherein the cover has at least one horizontal sheet metal segment and two vertical sheet metal segments, which are interconnected via connection devices and which between them have a slit for discharging liquid, e.g. surface water, into the gutter body, achieved in that the horizontal sheet metal segment comprises dripping device, which are mounted and formed such that water running along the underneath of the horizontal sheet metal segment drips into the gutter body.

In this way the amounts of water, which initially appear very small but which flow rather steadily, and which run along the underneath of the horizontal sheet metal segment due to adhesion forces, do not reach the environment. This occurs in particular when the flow of water into the slit gutter is small and not when it is particularly strong.

In the present case, it is assumed that the slit gutter is constructed "asymmetrically", i.e. it has only one horizontal sheet metal segment, which is integrally connected to a vertical sheet metal segment. A symmetrical construction, however, in which two identical or similarly formed angle sections consisting of a horizontal and a vertical sheet metal segment form the cover, can be chosen as well.

The connecting directions are preferably formed from the two vertical sheet-metal segments as protrusions jutting out towards each other, which hold the two vertical segments at a distance from each other. These protrusions are then fastened to each other back-to-back using clinch connections or clinching. In this case a particularly simple method of attachment is used, which still results in great strength or safety. The connection can also be established by further positive and/or non-positive connection types, e.g. rivets, screws or hot caulking.

The horizontal sheet metal segment has support sections preferably extending transversely to a longitudinal axis of the slit gutter having preferably U-shaped cross-sections. In this way, relatively thin sheet metal can be used without compromising the required load safety.

The support sections are preferably connected to the horizontal sheet metal segment using clinch connections.

The drip devices can be designed in various ways and shapes. It has turned out to be particularly advantageous if the drip device comprises at least one pleat formed in the horizontal sheet metal segment and projecting downwards. This pleat then acts like a "drip edge", which directs the water flowing in from one side downwards and prevents the water from seeping into the environment via the outer rim of the horizontal sheet metal segment. This pleat has another considerable advantage with regard to the strength of the sheet metal, as the pleat prevents, or at the very least hampers, the metal from bending. However, it is also possible to provide a—preferably wider—pleat protruding upwards.

The pleat is preferably divided into several individual segments, which are each mounted between two support sections. On the one hand, this enables the support sections to be designed as simple U-shaped sections and to rest completely flush against the underside of the horizontal sheet metal segment. On the other hand, this division results in a mounting adjustment, such that the support sections can always be attached to defined locations of the horizontal sheet metal segment.

Slit grooves often include alignment elements for aligning abutting slit gutters having a first and a second slot, wherein the alignment element protrudes from a front end of the first slit and can be inserted into a rear end of the second slit. In general, for this purpose two sheet metal tabs are welded into the front and rear ends of a slit. However, this involves a lot of cost and effort and can cause injuries on the protruding and frequently sharp-edged metal tabs. According to the invention, however, the alignment element is fastened to the vertical sheet metal segments by the connection devices of the latter. This simplifies the installation and reduces the cost.

Preferably, the alignment is frictionally engaged in the slit. There are no strong forces, i.e. this simple mounting method is sufficient. Preferably, the alignment is bent as a hollow body of sheet metal, which constitutes a particularly simple production method. To that end, the hollow body does not have to be (completely) closed.

The alignment element preferably has a spring device compressible in a direction in a width of the slit, wherein a limitation of the spring travel is provided. As a result, a firm hold in the cover, to which the alignment is attached, is ensured on the one hand, on the other hand, the assembly on the site is very simple. Advantageously, this additionally prevents the alignment element from rattling in the cover.

At least one flat side of the alignment element may have a sheet metal extension integrally formed with the flat side (labeling surface), which can be bent in the direction of the second flat side and on which a surface for placing, for instance, a manufacturer or product name can be provided.

Advantageously, this surface engages with recesses provided in the folded upper area of the vertical sheet-metal segments to prevent a rotation of the alignment element about the fastening axis.

Figure 2:
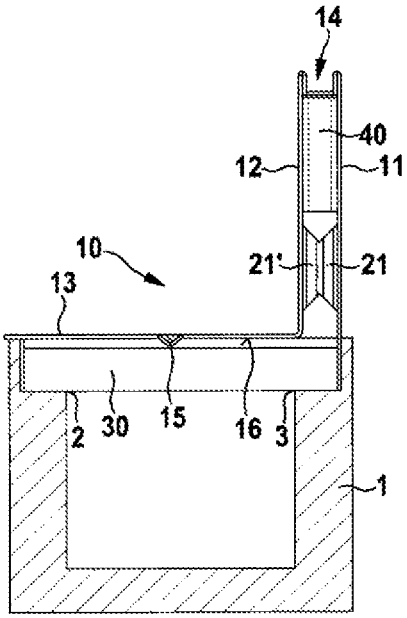
Figure 3:
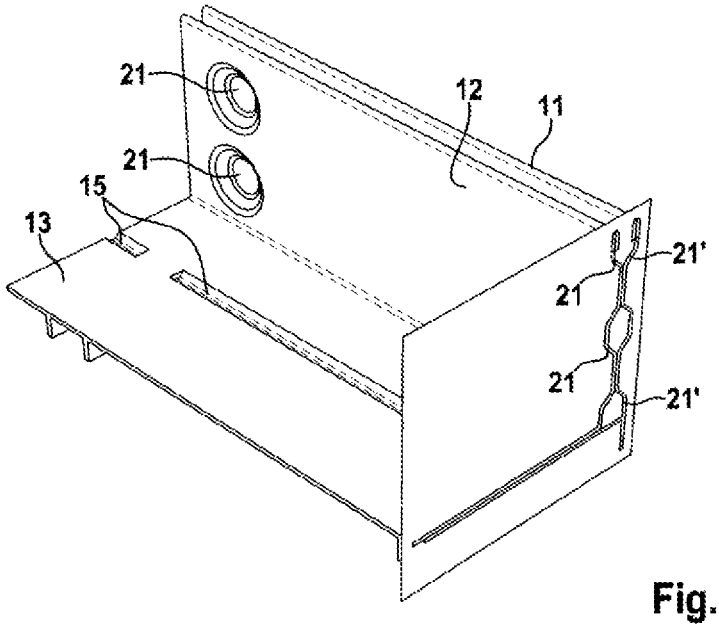
Figure 4:
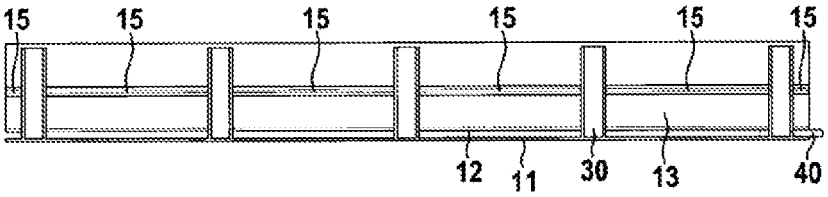
Figure 5:
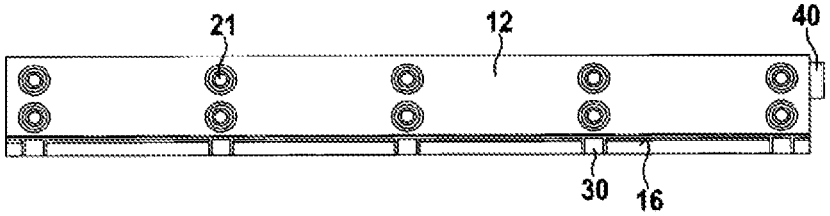
Figure 6:
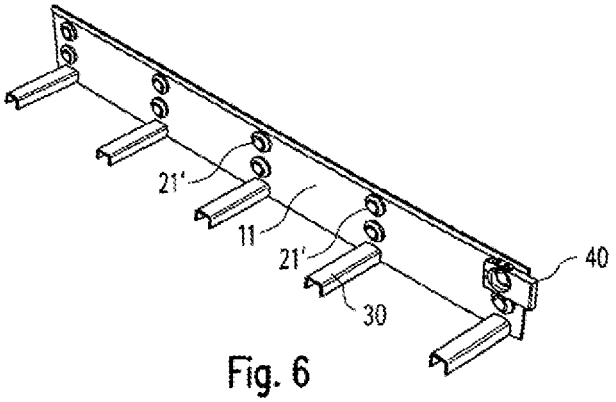
Figure 7:
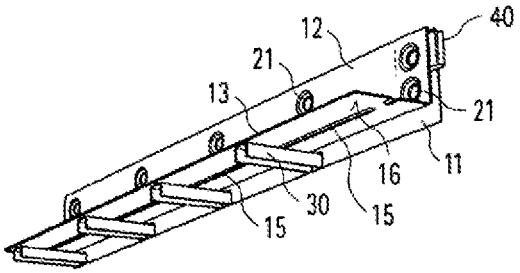
Figure 8:
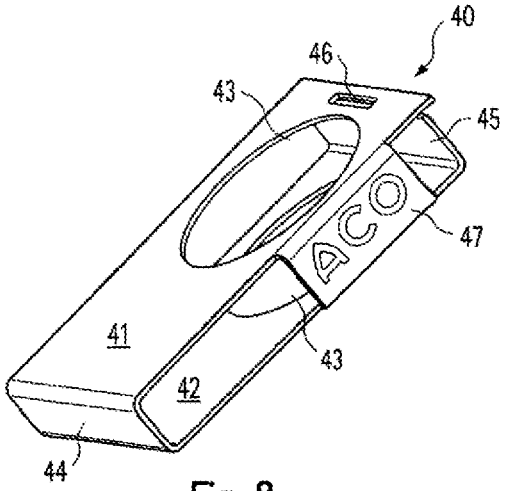
Figure 9:
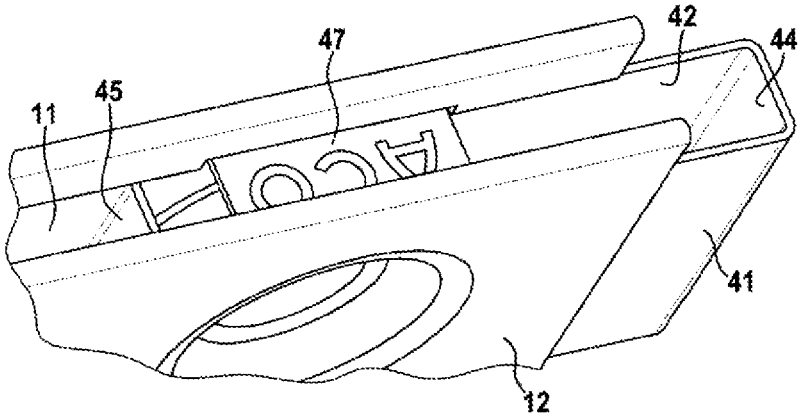

Below, an exemplary embodiment of the invention will be explained in more detail with reference to figures. In the figures FIG. 1 shows a perspective view of an embodiment of the invention, FIG. 2 shows an end view along the plane II-II of FIG. 1, FIG. 3 shows a sectional view through a segment of the gutter for explaining the protrusions, which form the connection device, FIG. 4 shows a bottom view along the arrow IV of FIG. 1, FIG. 5 shows a view from the side along the arrow V of FIG. 1, FIG. 6 shows the gutter according to FIG. 1 but without the horizontal sheet metal segment and the attached vertical sheet metal segment, FIG. 7 shows a perspective view of the cover of FIG. 6 from below, wherein one of the support sections has been omitted, FIG. 8 shows a perspective view of an alignment element, and FIG. 9 shows an enlarged view of the end area of the cover.

In the following description, the same reference numerals are used for identical and identically acting parts.

As shown in FIG. 1, the cover 10 comprises a first vertical sheet metal segment 11 and a second vertical sheet metal segment 12, which merges into a horizontal sheet metal segment 13. A slit 14 is formed between the two vertical sheet metal segments 11 and 12.

The horizontal sheet metal segment 13 has a drip device formed as a pleat 15 (see FIG. 2), which acts to make water, which flows on the beneath 16 of the horizontal sheet metal segment 13 due to adhesion forces to the outside (in FIG. 2 to the left), drop into the gutter body 1, in the upper rims 2 and 3 of which the cover 10 is located.

The two sheet metal parts, in particular their vertical segments 11 and 12 have dish-shaped indentations or protrusions 21, 21', which are mounted such that the flat bottoms of these protrusions 21, 21' come to rest back-to-back of each other if the vertical sheet metal segments 11, 12 are joined in the manner intended by the design. These sheet metal segments or protrusions 21, 21' are connected by clinching, a particularly simple and inexpensive but very durable type of attachment. The joining of the vertical sheet metal segments 11 and 12 is shown particularly clearly in FIG. 3.

Support sections 30 are attached at the bottom 16 of the horizontal sheet metal segment 12, once again by clinching. For this purpose, the pleats 15 are omitted, as can be seen in particular from FIG. 7, in the areas in which the support sections 30 come to rest.

Alignment elements 40 are provided to assemble a whole gutter strand as easily as possible on the construction site. Reference is made in particular to FIG. 8. The alignment element 40 shown here is bent from a single piece of sheet metal as a hollow body, wherein a first flat side 41 and a second flat side 42 are provided with holes 43 which are aligned with each other and the diameter of which corresponds to the maximum diameter of the protrusions 21 and 21.

The flat sides 41, 42 are connected to each other via an end segment 44, which has a certain spring tension. The other end segment 45 has an adjusting element 46, which is formed as a tooth and inserted into a corresponding slit on the first flat side. As a result, the alignment element 40 can be bent only by a certain amount, but is always spring-tensioned. In this way, successive slit gutters can be easily installed in series. A manufacturer's name is imprinted on the labeling surface 47.

FIG. 9 shows an enlarged view of the end area of the cover of a slit gutter according to an exemplary embodiment of the invention. In the folded upper area of the two vertical sheet metal segments 11 and 12, opposite recesses 17, 18 are formed, with which the labeling surface 47 engages. In this way, any rotation of the alignment element 40 about the mounting axis is counteracted.

Below, further exemplary embodiments are mentioned:

1st Exemplary Embodiment

The cover (10) of a slit gutter, comprising a gutter body (1) having upper rims (2, 3) for fitting the cover (10), wherein the cover (10) has at least one horizontal sheet metal segment (13) and two vertical sheet metal segments (11, 12), which are interconnected via connection devices (20) and which between them have a slit (14) for discharging liquids, e.g. surface water, into the gutter body (1), characterized in that the horizontal sheet metal segment (13) comprises drip devices (15), which are mounted and formed such that the water running along the underneath (16) of the horizontal sheet metal segment (13) drips into the gutter body (1).

2nd Exemplary Embodiment

The cover according to the exemplary embodiment 1, characterized in that the connection devices (20) made of the second vertical sheet metal segments (11, 12) comprise protrusions (21, 21') jutting out towards each other, which are fastened to each other using clinch connections or clinching.

3rd Exemplary Embodiment

The cover according to any one of the preceding exemplary embodiments, characterized in that the horizontal plate segment (13) has support sections (30) extending transversely to a longitudinal axis of the slit gutter having preferably U-shaped cross-sections.

4th Exemplary Embodiment

The cover according to any one of the preceding exemplary embodiments, in particular according to the exemplary embodiment 3, characterized in that the support sections (30) are connected to the horizontal sheet metal segment (13) using clinch connections.

5th Exemplary Embodiment

The cover according to any one of the preceding exemplary embodiments, characterized in that the drip device (15) comprises at least one pleat formed into the horizontal sheet-metal segment (13) and preferably protruding downwards.

6th Exemplary Embodiment

The cover according to any one of the preceding exemplary embodiments, in particular according to one of the embodiments 3 or 4, characterized in that in each case there is at least one pleat (15) between every two support sections (30).

7th Exemplary Embodiment

A cover according to any one of the preceding exemplary embodiments, comprising an alignment element (40) for aligning abutting slit gutters having a first and a second slot, wherein the alignment element (40) protrudes from a front end (17) of the first slit (14) and can be inserted into a rear end (17) of a second slit, characterized in that the alignment element (40) is fastened to the vertical sheet metal segments (11, 12) by the connection device (20) of the latter.

8$^{th}$ Exemplary Embodiment

The cover according to any one of the preceding exemplary embodiments, in particular according to the exemplary embodiment 7, characterized in that the alignment element (40) is held in the slit (14) by friction.

9$^{th}$ Exemplary Embodiment

The cover according to any one of the preceding exemplary embodiments, in particular according to the exemplary embodiment 7 or 8, characterized in that the alignment element (40) is bent as a hollow body of sheet metal.

10$^{th}$ Exemplary Embodiment

The cover according to any one of the preceding exemplary embodiments, in particular according to one of the embodiments 7 to 9, characterized in that the alignment element (40) has a spring device compressible in a direction in a width of the slit (14), wherein a limitation of the spring travel is provided.

LIST OF THE REFERENCE NUMERALS

1 gutter body
2 upper rim
3 upper rim
10 cover
11 first vertical sheet metal section
12 second vertical sheet metal section
13 horizontal sheet metal section
14 slit
15 drip device/pleat
16 beneath
17 front/rear end
18 recess
19 recess
20 connection device
21, protrusion
30 support section
40 alignment element
41 first flat side
42 second flat side
43 holes
44 end segment
45 other end section
46 adjusting element
47 labeling surface

The invention claimed is:

1. A cover (10) of a slit gutter, comprising
a gutter body (1) having upper rims (2, 3) for fitting the cover (10),
wherein the cover (10) has at least one horizontal sheet metal segment (13) and two vertical sheet metal segments (11, 12), which are interconnected via connection devices (20), and a slit (14) for discharging liquids into the gutter body (1) is located between the two vertical sheet metal segments (11, 12), an alignment element (40) for aligning abutting slit gutters having a first slot and a second slot, wherein the alignment element (40) protrudes from a front end (17) of the slit (14) and can be inserted into a rear end (17) of a second slit,
characterized in that
the alignment element (40) is fastened to the two vertical sheet metal segments (11, 12) by the connection device (20) of the latter.

2. The cover according to claim 1,
characterized in that
the connection devices (20) made of the two vertical sheet metal segments (11, 12) comprise protrusions (21, 21') jutting out towards each other, which are fastened to each other using clinch connections.

3. The cover according to claim 1,
characterized in that
the alignment element (40) is held in the slit (14) by friction.

4. The cover according to claim 1,
characterized in that
the alignment element (40) is made of sheet metal and bent as a hollow body.

5. The cover according to claim 1,
characterized in that
the alignment element (40) has a spring device compressible in a direction in a width of the slit (14), wherein a limitation of the spring travel is provided.

6. The cover according to claim 1,
characterized in that
the horizontal plate segment (13) has support sections (30) extending transversely to a longitudinal axis of the slit (14), the support profiles (30) having U shaped cross-sections.

7. The cover according to claim 6,
characterized in that
the support sections (30) are connected to the horizontal sheet metal segment (13) using clinch connections.

8. The cover according to claim 1,
characterized in that
the horizontal sheet metal segment (13) comprises dripping devices mounted and formed such that the water running underneath (16) of the horizontal sheet metal segment (13) drips into the gutter body (1).

9. The cover according to claim 8,
characterized in that
a drip device comprises at least one pleat (15) formed into the horizontal sheet-metal segment (13).

10. The cover according to claim 9,
characterized in that
there is at least one pleat (15) between every two support sections (30).

* * * * *